US008484953B2

(12) United States Patent
Gonze et al.

(10) Patent No.: US 8,484,953 B2
(45) Date of Patent: Jul. 16, 2013

(54) ELECTRICALLY HEATED PARTICULATE FILTER USING CATALYST STRIPING

(75) Inventors: Eugene V. Gonze, Pinckney, MI (US); Michael J. Paratore, Jr., Howell, MI (US); Frank Ament, Troy, MI (US)

(73) Assignee: GM Global Technology Operations LLC

( * ) Notice: Subject to any disclaimer, the term of this patent is extended or adjusted under 35 U.S.C. 154(b) by 855 days.

(21) Appl. No.: 11/876,136

(22) Filed: Oct. 22, 2007

(65) Prior Publication Data

US 2008/0307781 A1 Dec. 18, 2008

Related U.S. Application Data

(60) Provisional application No. 60/934,988, filed on Jun. 15, 2007.

(51) Int. Cl.

| | |
|---|---|
| ***F01N 3/00*** | (2006.01) |
| ***F01N 3/10*** | (2006.01) |
| ***B01D 39/00*** | (2006.01) |
| ***B01D 41/00*** | (2006.01) |
| ***B01D 45/00*** | (2006.01) |
| ***B01D 46/00*** | (2006.01) |
| ***B01D 49/00*** | (2006.01) |
| ***B01D 50/00*** | (2006.01) |
| ***B01D 51/00*** | (2006.01) |

(52) U.S. Cl.

USPC ..... 60/295; 60/299; 60/303; 55/282.3; 95/283; 95/285

(58) Field of Classification Search

USPC ..... 60/273, 295, 297, 299, 300, 303, 60/274; 95/273, 278, 283, 285, 287; 55/282.2, 55/282.3, 282.5, 283

See application file for complete search history.

(56) References Cited

U.S. PATENT DOCUMENTS

| | | | | |
|---|---|---|---|---|
| 4,505,107 | A * | 3/1985 | Yamaguchi et al. | 60/303 |
| 4,505,726 | A | 3/1985 | Takeuchi | |
| 4,516,993 | A | 5/1985 | Takeuchi | |
| 4,872,889 | A * | 10/1989 | Lepperhoff et al. | 55/282.3 |
| 4,934,142 | A * | 6/1990 | Hayashi et al. | 60/297 |

(Continued)

FOREIGN PATENT DOCUMENTS

| | | | |
|---|---|---|---|
| CN | 1920267 | A | 2/2007 |
| DE | 10048511 | A1 | 4/2002 |
| JP | 08296426 | A * | 11/1996 |
| WO | WO 2004067927 | A1 * | 8/2004 |

OTHER PUBLICATIONS

Yasuura et al., English Abstract of JP 08-296426 A, Nov. 12, 1996.*

(Continued)

*Primary Examiner* — Kenneth Bomberg
*Assistant Examiner* — Audrey K Bradley

(57) ABSTRACT

An exhaust system that processes exhaust generated by an engine is provided. The system generally includes a particulate filter (PF) that filters particulates from the exhaust wherein an upstream end of the PF receives exhaust from the engine. A grid of electrically resistive material is applied to an exterior upstream surface of the PF and selectively heats exhaust passing through the grid to initiate combustion of particulates within the PF. A catalyst coating is applied to the PF that increases a temperature of the combustion of the particulates within the PF.

18 Claims, 5 Drawing Sheets

U.S. PATENT DOCUMENTS

| | | | | |
|---|---|---|---|---|
| 5,665,322 | A * | 9/1997 | Kiyohide et al. | 423/213.5 |
| 5,846,276 | A * | 12/1998 | Nagai et al. | 55/523 |
| 6,245,306 | B1 * | 6/2001 | Miyazaki et al. | 423/215.5 |
| 6,770,116 | B2 * | 8/2004 | Kojima | 95/14 |
| 2004/0226287 | A1 * | 11/2004 | Edgar et al. | 60/295 |
| 2004/0254072 | A1 * | 12/2004 | Yan et al. | 502/439 |
| 2005/0060990 | A1 * | 3/2005 | Ueno et al. | 60/295 |
| 2006/0057046 | A1 * | 3/2006 | Punke et al. | 423/215.5 |
| 2007/0028604 | A1 | 2/2007 | Twigg et al. | |
| 2007/0044460 | A1 * | 3/2007 | Gonze et al. | 60/297 |
| 2007/0062181 | A1 * | 3/2007 | Williamson et al. | 60/297 |
| 2007/0220869 | A1 | 9/2007 | Gonze et al. | |

OTHER PUBLICATIONS

Yasuura et al., Machine Translation of JP 08-296426 A, Nov. 12, 1996.*

U.S. Appl. No. 11/209,427, Gonze, filed Aug. 23, 2005.

* cited by examiner

ELECTRICALLY HEATED PARTICULATE FILTER USING CATALYST STRIPING

CROSS-REFERENCE TO RELATED APPLICATIONS

This application claims the benefit of U.S. Provisional Application No. 60/934,988, filed on Jun. 15, 2007. The disclosure of the above application is incorporated herein by reference.

STATEMENT OF GOVERNMENT RIGHTS

This invention was produced pursuant to U.S. Government Contract No. DE-FC-04-03 AL67635 with the Department of Energy (DoE). The U.S. Government has certain rights in this invention.

FIELD

The present disclosure relates to methods and systems for heating particulate filters.

BACKGROUND

The statements in this section merely provide background information related to the present disclosure and may not constitute prior art.

Diesel engines typically have higher efficiency than gasoline engines due to an increased compression ratio and a higher energy density of diesel fuel. A diesel combustion cycle produces particulates that are typically filtered from diesel exhaust by a particulate filter (PF) that is disposed in the exhaust stream. Over time, the PF becomes full and the trapped diesel particulates must be removed. During regeneration, the diesel particulates are burned within the PF.

Conventional regeneration methods inject fuel into the exhaust stream after the main combustion event. The post-combustion injected fuel is combusted over one or more catalysts placed in the exhaust stream. The heat released during the fuel combustion on the catalysts increases the exhaust temperature, which burns the trapped soot particles in the PF. This approach, however, can result in higher temperature excursions than desired, which can be detrimental to exhaust system components, including the PF.

SUMMARY

Accordingly, an exhaust system that processes exhaust generated by an engine is provided. The system generally includes a particulate filter (PF) that filters particulates from the exhaust wherein an upstream end of the PF receives exhaust from the engine. A grid of electrically resistive material is applied to an exterior upstream surface of the PF and selectively heats exhaust passing through the grid to initiate combustion of particulates within the PF. A catalyst coating is applied to the PF that increases a temperature of the combustion of the particulates within the PF.

In other features, a method of regenerating a particulate filter (PF) of an exhaust system is provided. The method generally includes: applying a grid of electrically resistive material to a front exterior surface of the PF; heating the grid by supplying current to the electrically resistive material; inducing combustion of particulates present on the front surface of the PF via the heated grid; directing heat generated by combustion of the particulates into the PF to induce combustion of particulates within the PF via exhaust; and increasing a temperature of the combustion of the particulates via a carbon monoxide conversion of the exhaust.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 3:
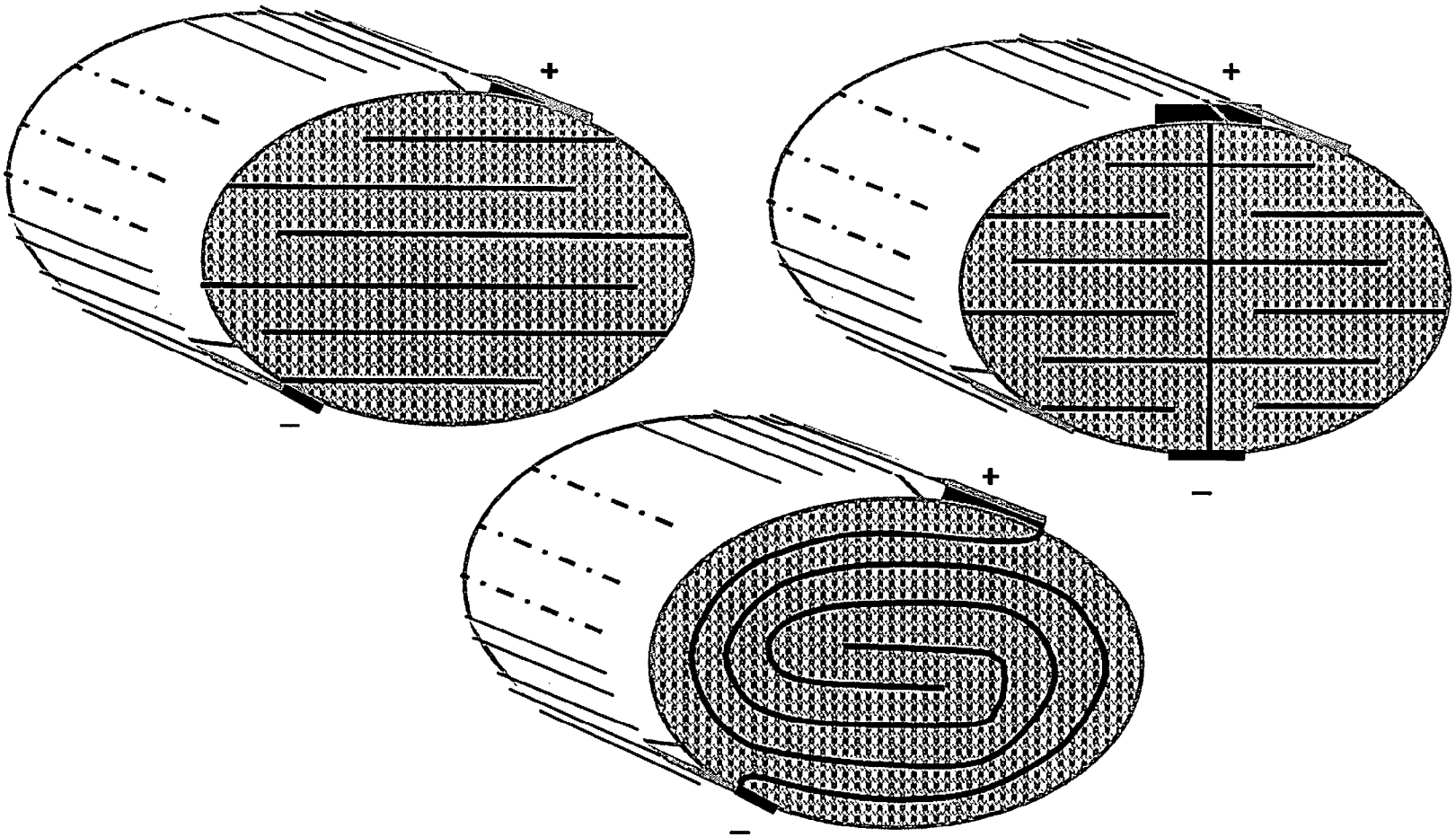

FIG. 3 includes perspective views of exemplary front faces of particulate filters illustrating various patterns of resistive paths.

Figure 4:
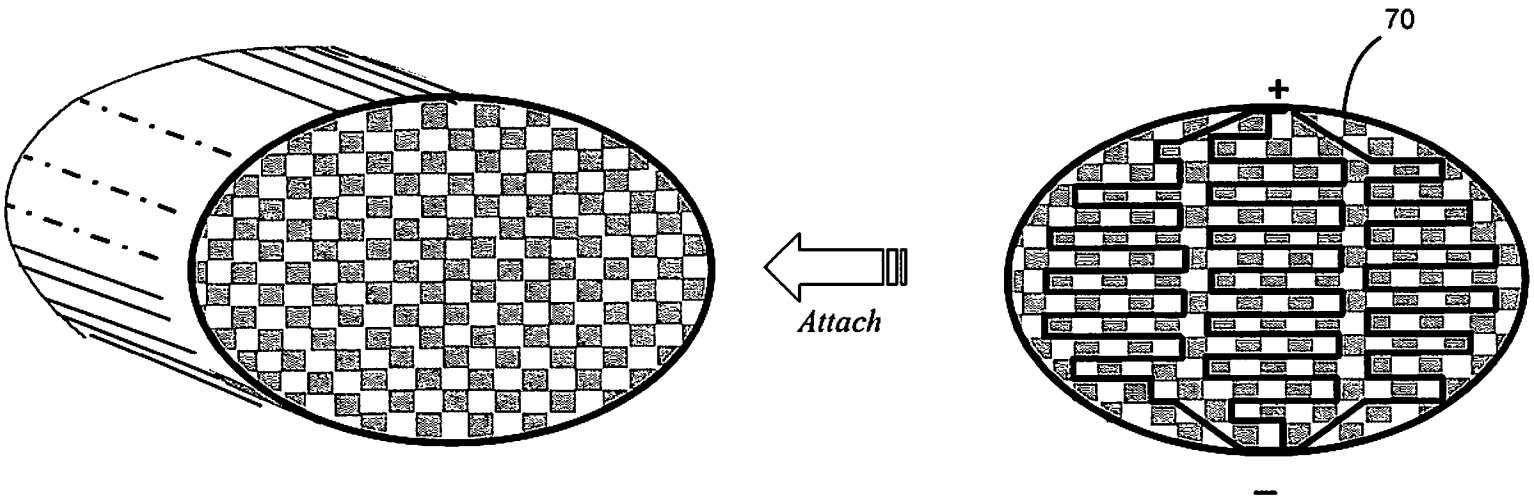

FIG. 4 is a perspective view of a front face of an exemplary particulate filter and a heater insert.

Figure 2:
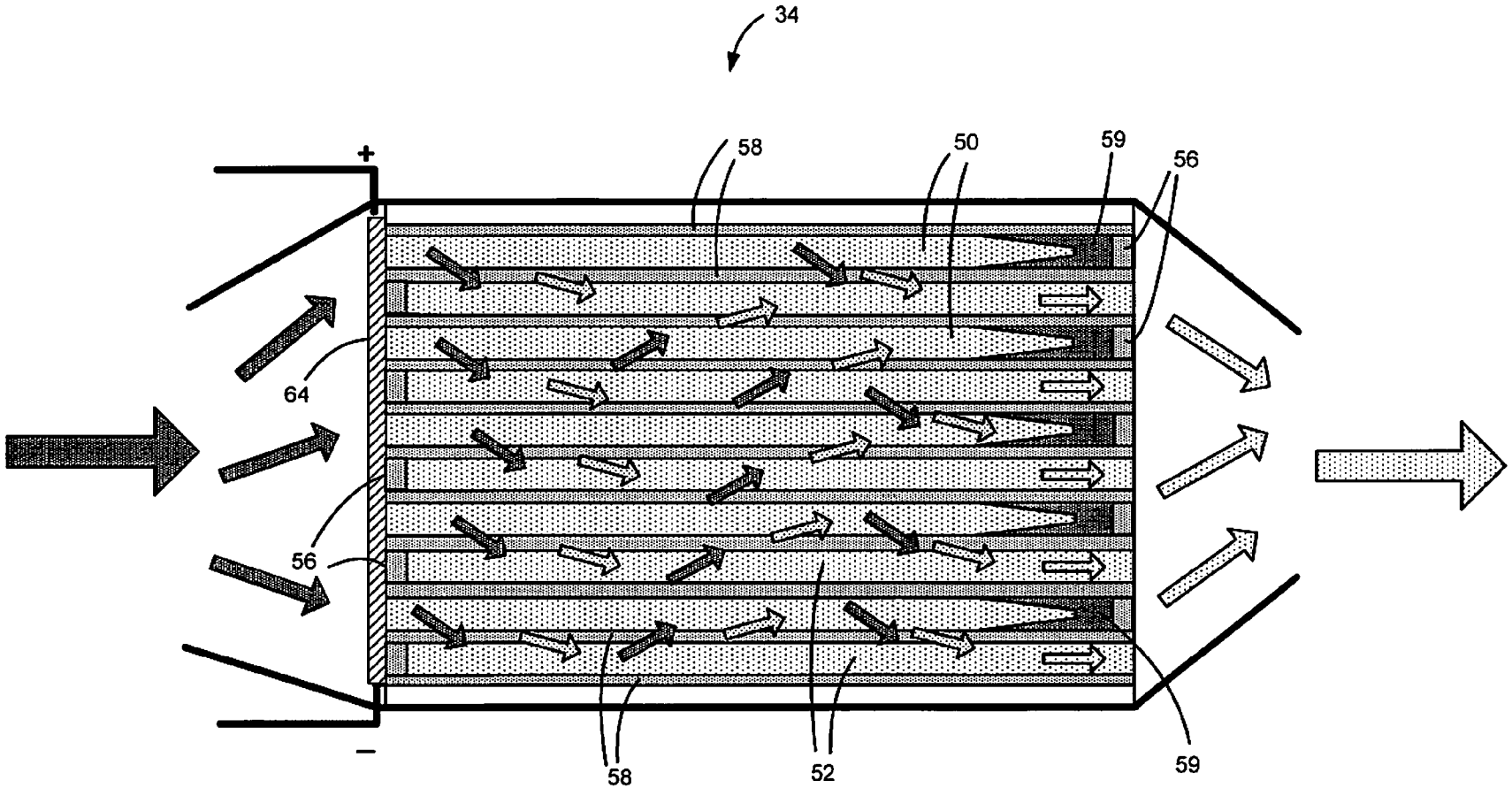
FIG. 2 is a cross-sectional view of an exemplary wall-flow monolith particulate filter.
Figure 5:
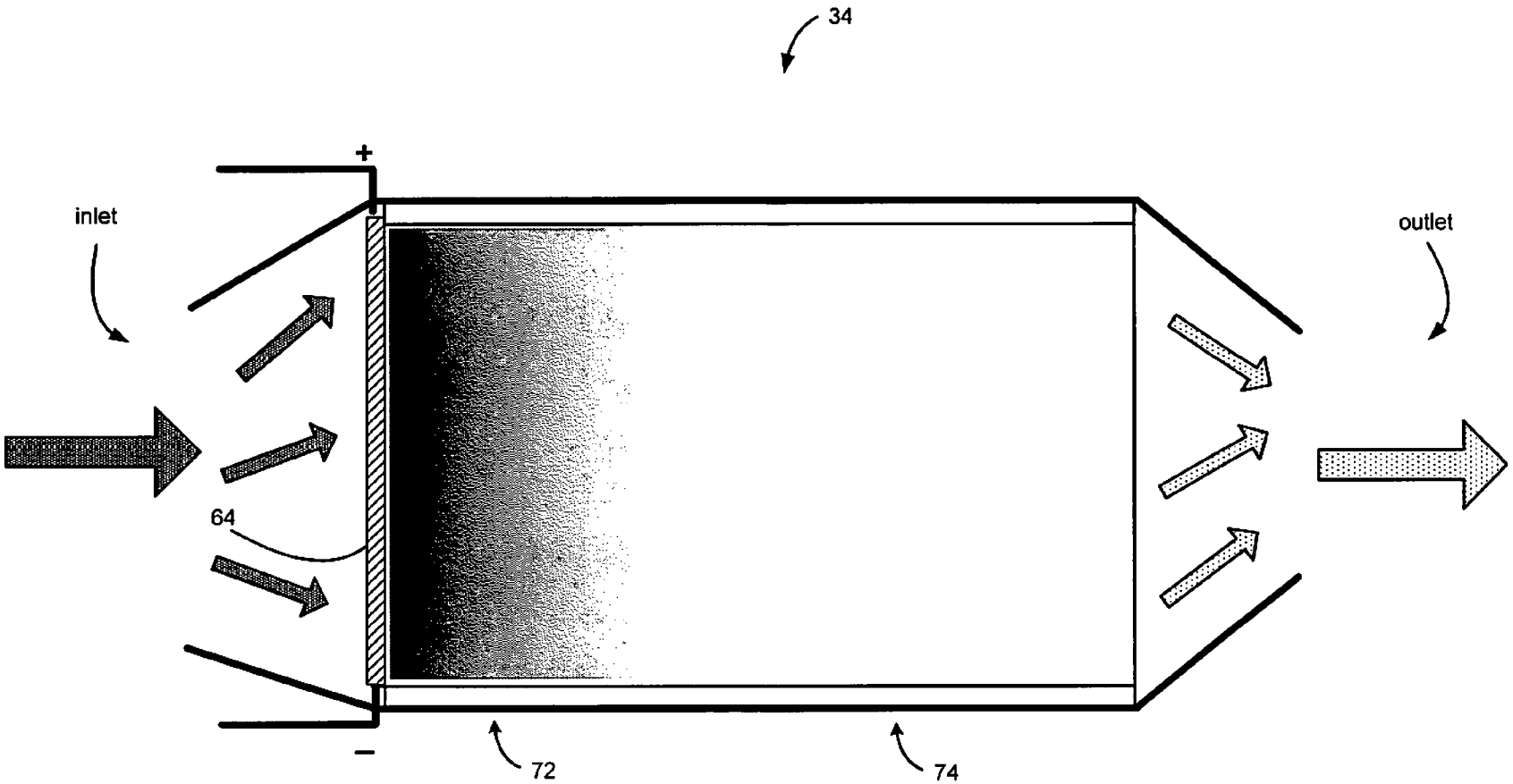

FIG. 5 is a cross-sectional view of the exemplary particulate filter of FIG. 2 including a catalyst coating according to various aspects of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
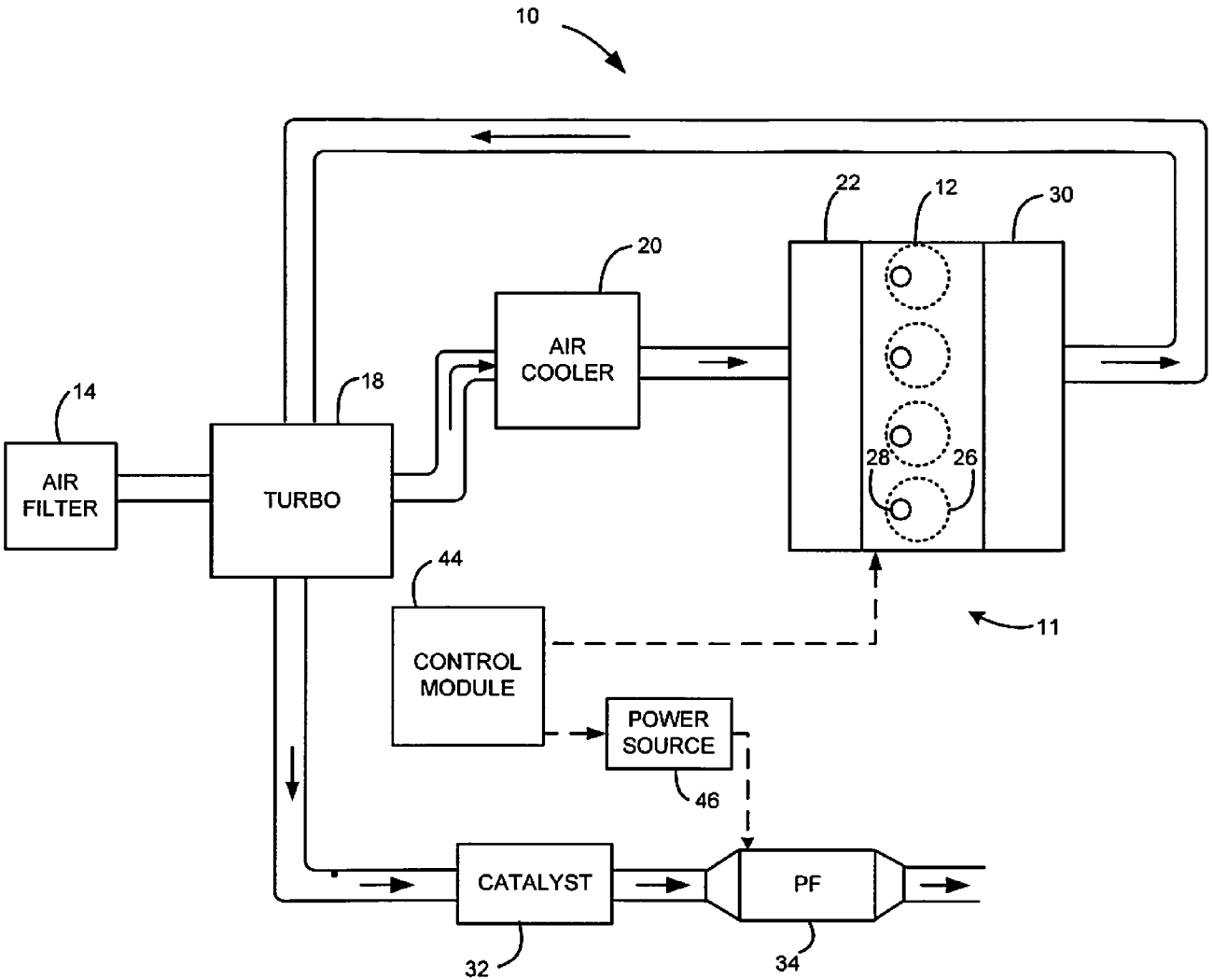
FIG. 1 is a functional block diagram of an exemplary vehicle including a particulate filter and a particulate filter regeneration system according to various aspects of the present disclosure.

Referring now to FIG. 1, an exemplary vehicle 10 including a diesel engine system 11 is illustrated in accordance with various aspects of the present disclosure. It is appreciated that the diesel engine system 11 is merely exemplary in nature and that the particulate filter regeneration system described herein can be implemented in various engine systems implementing a particulate filter. Such engine systems may include, but are not limited to, gasoline direct injection engine systems and homogeneous charge compression ignition engine systems. For ease of the discussion, the disclosure will be discussed in the context of a diesel engine system.

A turbocharged diesel engine system 11 includes an engine 12 that combusts an air and fuel mixture to produce drive torque. Air enters the system by passing through an air filter 14. Air passes through the air filter 14 and is drawn into a turbocharger 18. The turbocharger 18 compresses the fresh air entering the system 11. The greater the compression of the air generally, the greater the output of the engine 12. Compressed air then passes through an air cooler 20 before entering into an intake manifold 22.

Air within the intake manifold 22 is distributed into cylinders 26. Although four cylinders 26 are illustrated, it is appreciated that the systems and methods of the present disclosure can be implemented in engines having a plurality of cylinders including, but not limited to, 2, 3, 4, 5, 6, 8, 10 and 12 cylinders. It is also appreciated that the systems and methods of the present disclosure can be implemented in a v-ype cylinder configuration. Fuel is injected into the cylinders 26 by fuel injectors 28. Heat from the compressed air ignites the air/fuel mixture. Combustion of the air/fuel mixture creates exhaust. Exhaust exits the cylinders 26 into the exhaust system.

The exhaust system includes an exhaust manifold 30, a diesel oxidation catalyst (catalyst) 32, and a particulate filter (PF) 34. Optionally, an EGR valve (not shown) re-circulates a portion of the exhaust back into the intake manifold 22. The remainder of the exhaust is directed into the turbocharger 18 to drive a turbine. The turbine facilitates the compression of the fresh air received from the air filter 14. Exhaust flows from the turbocharger 18 through the catalyst 32 and the PF 34. The catalyst 32 oxidizes the exhaust based on the post combustion air/fuel ratio. The PF 34 receives exhaust from the catalyst 32 and filters any particulate matter particulates present in the exhaust.

A control module 44 controls the engine 12 and PF regeneration based on various sensed and/or modeled information. More specifically, the control module 44 estimates particulate matter loading of the PF 34. When the estimated particulate matter loading achieves a threshold level (e.g., 5 grams/liter of particulate matter) and the exhaust flow rate is within a desired range, current is controlled to the PF 34 via a power source 46 to initiate the regeneration process. The duration of the regeneration process varies based upon the amount of particulate matter within the PF 34. It is anticipated, that the regeneration process can last between 1-6 minutes. Current is only applied, however, during an initial portion of the regeneration process. More specifically, the electric energy heats the face of the PF 34 for a threshold period (e.g., 1-2 minutes). Exhaust passing through the front face is heated. The remainder of the regeneration process is achieved using the heat generated by combustion of the particulate matter present near the heated face of the PF 34 or by the heated exhaust passing through the PF 34.

With particular reference to FIG. 2, the PF 34 is preferably a monolith particulate trap and includes alternating closed cells/channels 50 and opened cells/channels 52. The cells/channels 50, 52 are typically square cross-sections, running axially through the part. Walls 58 of the PF 34 are preferably comprised of a porous ceramic honeycomb wall of cordierite material. It is appreciated that any ceramic comb material is considered within the scope of the present disclosure. Adjacent channels are alternatively plugged at each end as shown at 56. This forces the diesel aerosol through the porous substrate walls which act as a mechanical filter. Particulate matter is deposited within the closed channels 50 and exhaust exits through the opened channels 52. Particulate matter 59 flow into the PF 34 and are trapped therein.

For regeneration purposes, a grid 64 including an electrically resistive material is attached to the front exterior surface referred to as the front face of the PF 34. Current is supplied to the resistive material to generate thermal energy. It is appreciated that thick film heating technology may be used to attach the grid 64 to the PF 34. For example, a heating material such as Silver or Nichrome may be coated then etched or applied with a mask to the front face of the PF 34. In various other embodiments, the grid 64 is composed of electrically resistive material such as stainless steel and attached to the PF 34 using an adhesive or press fit to the PF 34.

It is also appreciated that the resistive material may be applied in various single or multi-path patterns as shown in FIG. 3. Segments of resistive material can be removed to generate the pathways. In various embodiments a perforated heater insert 70 as shown in FIG. 4 may be attached to the front face of the PF 34. In any of the above mentioned embodiments, exhaust passing through the PF 34 carries thermal energy generated at the front face of the PF 34 a short distance down the channels 50, 52. The increased thermal energy ignites the particulate matter present near the inlet of the PF 34. The heat generated from the combustion of the particulates is then directed through the PF 34 to induce combustion of the remaining particulates within the PF 34.

With particular reference to FIG. 5, a catalyst coating is additionally applied to the PF 34. According to the present disclosure, the catalyst coating is distributed in sub-sections at varying densities optimized by an operating temperature of the PF 34. As can be appreciated, the density of the catalyst coatings can be applied in a step-like format or a continuous or linear format.

As shown in FIG. 5, an exemplary PF 34 includes an inlet that allows the exhaust to enter the PF 34 and an outlet that allows the exhaust to exit the PF 34. The PF 34 includes a first sub-section 72 and a second sub-section 74. The first sub-section 72 is located a first distance from the inlet. The second sub-section 74 is located a second distance from the inlet that is greater than the first distance. The first sub-section 72 is coated with catalysts at a first density. The first coating can include an oxidation catalyst that reduces Hydrocarbon and Carbon Monoxide. The oxidation catalyst includes, but is not limited to, palladium, platinum, and/or the like. The second sub-section 74 can be coated with catalysts at a second density or alternatively, not coated at all. If coated, the second density is less than the first density. The second coating can also include an oxidation catalyst that reduces Hydrocarbon and Carbon Monoxide, as discussed above.

When the PF 34 includes the catalyst coating near the inlet, the catalyst material increases the exhaust flow temperature via the Carbon Monoxide conversion and improves the soot combustion. By enhancing soot combustion in the front of the PF 34, the overall cooling effect of the high exhaust flows can be mitigated. The reverse is true near the outlet of the PF 34. By eliminating or reducing catalyst coating in the rear of the PF 34, excessive temperatures that may cause damage to the PF 34 can be reduced.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. An exhaust system that processes exhaust generated by an engine, comprising:

a particulate filter (PF) that filters particulates from the exhaust wherein an upstream end of the PF receives exhaust from the engine;

a grid of electrically resistive material that is applied to an exterior upstream surface of the PF and that selectively heats exhaust passing through the grid to initiate combustion of particulates within the PF;

a catalyst coating that is applied to the PF and that increases a temperature of the combustion of the particulates within the PF, wherein the catalyst coating is applied with a first thickness in a first sub-section of the PF, the catalyst coating is applied with a second thickness in a second sub-section of the PF, the first thickness is greater than the second thickness; and an electronic circuit that, when an exhaust flow rate is within a desired range, is configured to activate the grid of electrically resistive material for a predetermined period that is less than a regeneration period of the PF.

2. The exhaust system of claim 1, wherein the electronic circuit includes at least one of an Application Specific Integrated Circuit (ASIC), a processor and memory including one or more programs, and a combinational logic circuit.

3. An exhaust system that processes exhaust generated by an engine, comprising:

a particulate filter (PF) that filters particulates from the exhaust wherein an upstream end of the PF receives exhaust from the engine, the PF including a closed channel that is closed at the upstream end;

a grid of electrically resistive material that is applied to an exterior upstream surface of the PF and that selectively heats exhaust passing through the grid to initiate combustion of particulates within the PF;

a catalyst coating that is applied to the PF and that increases a temperature of the combustion of the particulates within the PF, wherein the catalyst coating is applied to an inner surface of the closed channel at a first thickness in a first sub-section of the PF, the catalyst coating is applied to the inner surface of the closed channel at a second thickness in a second sub-section of the PF that is downstream from the first sub-section, and the first thickness is greater than the second thickness; and an electronic circuit that, when an exhaust flow rate is within a desired range, is configured to activate the grid of electrically resistive material for a predetermined period that is less than a regeneration period of the PF.

4. The exhaust system of claim 3 wherein the first sub-section is a first distance from an inlet of the PF and the second sub-section is a second distance from the inlet of the PF and wherein the second distance is greater than the first distance.

5. The exhaust system of claim 3 wherein the catalyst coating includes an oxidation catalyst material.

6. The exhaust system of claim 3 wherein the catalyst coating is applied in a step format.

7. The exhaust system of claim 3 wherein the catalyst coating linearly decreases in thickness from the first thickness to the second thickness.

8. The exhaust system of claim 3, wherein the electronic circuit includes at least one of an Application Specific Integrated Circuit (ASIC), a processor and memory including one or more programs, and a combinational logic circuit.

9. The exhaust system of claim 3 wherein the electronic circuit is configured to control current to the grid to initiate regeneration during an initial period of a PF regeneration cycle.

10. The exhaust system of claim 9 wherein the electronic circuit is configured to estimate an amount of particulates within the PF and wherein the current is controlled when the amount exceeds a threshold amount.

11. A method of regenerating a particulate filter (PF) of an exhaust system, comprising:

applying a grid of electrically resistive material to a front exterior surface of the PF, the PF including a closed channel that is closed at an upstream end of the PF;

heating the grid when an exhaust flow rate is within a desired range by supplying current to the electrically resistive material for a predetermined period that is less than a regeneration period of the PF;

inducing combustion of particulates present on the front surface of the PF via the heated grid;

directing heat generated by combustion of the particulates into the PF to induce combustion of particulates within the PF via exhaust;

increasing a temperature of the combustion of the particulates via a carbon monoxide conversion of the exhaust;

providing a catalyst coating on an inner surface of the closed channel at a first thickness in a first sub-section of the PF; and providing the catalyst coating on the inner surface of the closed channel at a second thickness in a second sub-section of the PF that is downstream from the first sub-section, wherein the first thickness is greater than the second thickness.

12. The method of claim 11 further comprising controlling current to the grid to initiate regeneration during an initial period of a PF regeneration cycle.

13. The method of claim 12 further comprising estimating an amount of particulates within the PF and wherein the controlling is performed when the amount exceeds a threshold amount.

14. The method of claim 11 wherein the catalyst coating performs the carbon monoxide conversion.

15. The method of claim 14 wherein the catalyst coating includes an oxidation catalyst material.

16. The method of claim 14 wherein the providing the catalyst coating comprises providing the catalyst coating in a step format.

17. The method of claim 14 wherein the catalyst coating linearly decreases in thickness from the first thickness to the second thickness.

18. The method of claim 14 wherein the first sub-section is a first distance from an inlet of the PF, the second sub-section is a second distance from the inlet of the PF, and the second distance is greater than the first distance.

* * * * *